US005742987A

United States Patent [19]

Mikulec et al.

[11] Patent Number: 5,742,987

[45] Date of Patent: Apr. 28, 1998

[54] BUCKLE FOR USE WITH A PRETENSIONER

[75] Inventors: Michael A. Mikulec, Highland, Mich.; David Burke, Cumbria, England; Harjeet Gill, Ontario, Canada; Andrew Downie, Cumbria, England; Tony Chamings, Royal Oak, Mich.

[73] Assignee: AlliedSignal Inc., Morristown, N.J.

[21] Appl. No.: 712,064

[22] Filed: Sep. 11, 1996

[51] Int. Cl.[6] ..... A44B 11/26

[52] U.S. Cl. ..... 24/641; 24/633

[58] Field of Search ..... 24/633, 641, 642, 24/640

[56] References Cited

U.S. PATENT DOCUMENTS

| | | | |
|---|---|---|---|
| 5,066,042 | 11/1991 | Fohl | 24/633 X |
| 5,213,365 | 5/1993 | Fohl | 24/633 X |
| 5,496,068 | 3/1996 | Ball et al. | 24/633 X |
| 5,595,400 | 1/1997 | Wier | 24/633 X |
| 5,596,795 | 1/1997 | Beisswenger | 24/633 |

FOREIGN PATENT DOCUMENTS

| | | |
|---|---|---|
| 0 368 277 A | 5/1990 | European Pat. Off. . |
| 0 559 403 A | 5/1990 | European Pat. Off. . |
| 0 384 705 A | 8/1990 | European Pat. Off. . |
| 0 447 762 A | 9/1991 | European Pat. Off. . |
| 0 569 886 A | 11/1993 | European Pat. Off. . |
| 2 271 378 | 4/1994 | United Kingdom . |

*Primary Examiner*—James R. Brittain

*Attorney, Agent, or Firm*—Markell Seitzman

[57] ABSTRACT

A seat belt buckle (100) operable with a pretensioner (330) connected thereto for moving the buckle a determinable distance to remove slack of the seat belt about an occupant, the buckle comprising: a frame (102), adapted to be connected to the pretensioner (330), defining a tongue receiving opening (170) to receive a tongue (173) as the tongue is moved in a first direction, the frame having a first opening (126*a*) therein, and opposing frame sides (108*a,b*), each side including a latch plate slot (110) arranged generally perpendicular to the first direction and an arcuate slot (112), the arcuate slot (112) including a first portion (112*a*) generally parallel to the latch plate slots (110) and a second portion (113*b*) angled thereto, a latch plate (180), having end portions (186) movable within the latch plate slots between a locked position in engagement with an opening within the tongue and with the first opening (136*a*), a weight assembly pivotally connected to the end portions of the latch plate to generate a force upon the latch plate during operation of the pretensioner tending to urge the latch plate into the first opening.

5 Claims, 9 Drawing Sheets

BUCKLE FOR USE WITH A PRETENSIONER

BACKGROUND AND SUMMARY OF THE INVENTION

The present invention generally relates to buckles for seat belts and more particularly to that type of buckle usable with a buckle pretensioner or belt tightener.

The present invention relates to a new and improved buckle for use with a pretensioner of a safety belt system and one which resists the very high g-forces generated when the pretensioner is activated. As known in the art, these g-forces arise as the pretensioner is rapidly moved to remove belt slack about an occupant. At the end of a pretensioning stroke the buckle frame (typically attached to the pretensioner) is suddenly stopped, however, due to inertia, the button tends to continue to move. This movement of the button, unless compensated may cause, in certain situations, a latch plate of the buckle to move out of its locked position, permitting the tongue to unlatch.

An object of the present invention is to overcome the above deficiency in the prior art.

Accordingly, the invention comprises: a seat belt buckle operable with a pretensioner connected thereto for moving the buckle a determinable distance to remove slack of the seat belt about an occupant, the buckle comprising: a frame, adapted to be connected to the pretensioner, defining a tongue receiving opening to receive a tongue as the tongue is moved in a first direction, the frame having a first opening therein, and opposing frame sides, each side including a latch plate slot arranged generally perpendicular to the first direction and an arcuate slot, the arcuate slot including a first portion generally parallel to the latch plate slots and a second portion angled thereto, a latch plate, having end portions movable within the latch plate slots between a locked position in engagement with an opening within the tongue and positioned within the first opening. A weight assembly means pivotally connected to the latch plate is provided to generate a force upon the latch plate during operation of the pretensioner tending to force the latch plate into the first opening A button is operatively received upon the frame having ramps for lifting the latch plate to its unlatched position.

Many other objects and purposes of the invention will be clear from the following detailed description of the drawings.

DETAILED DESCRIPTION OF THE DRAWINGS

Figure 1:
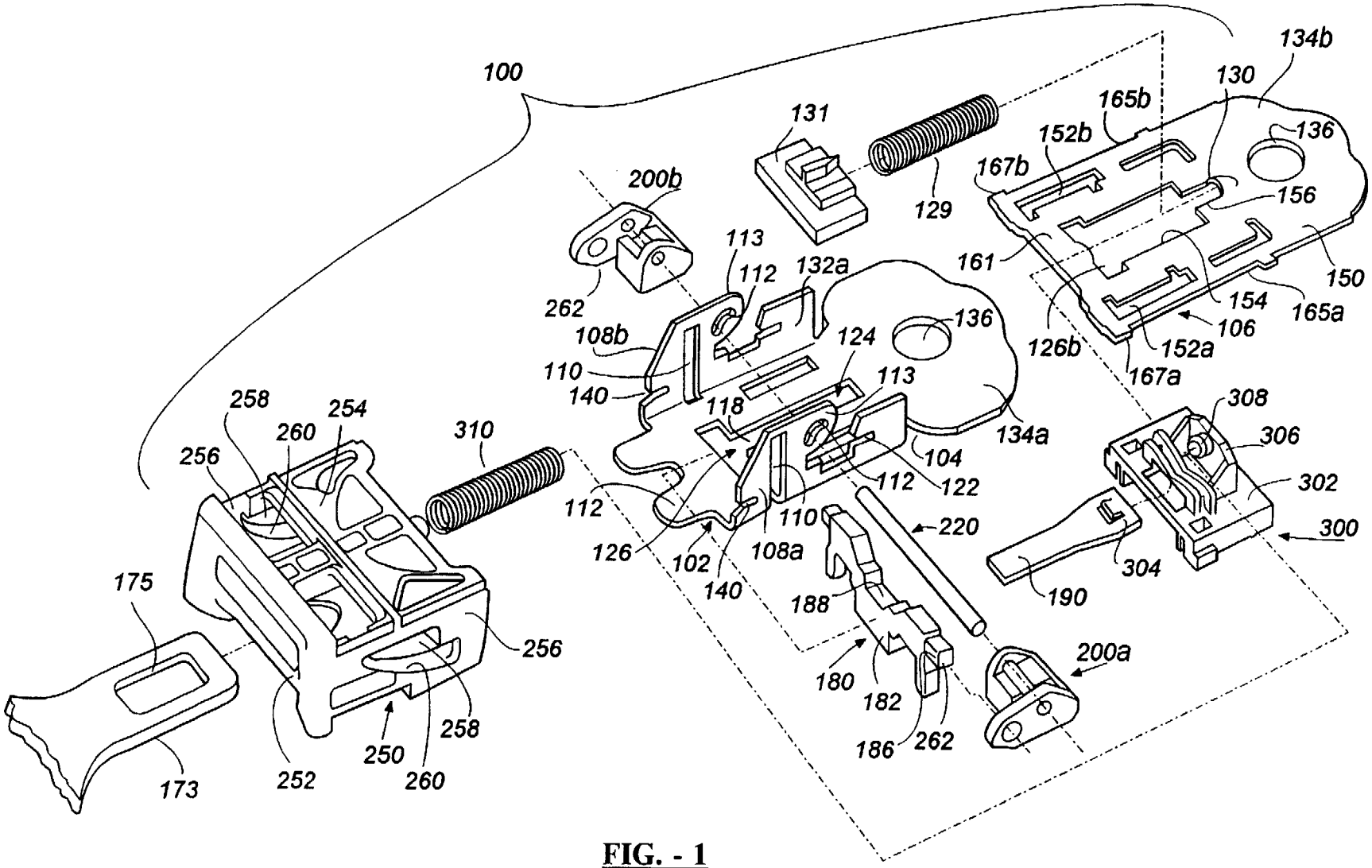
FIG. 1 is an assembly view showing many of the major elements of the present invention.
Figure 2:
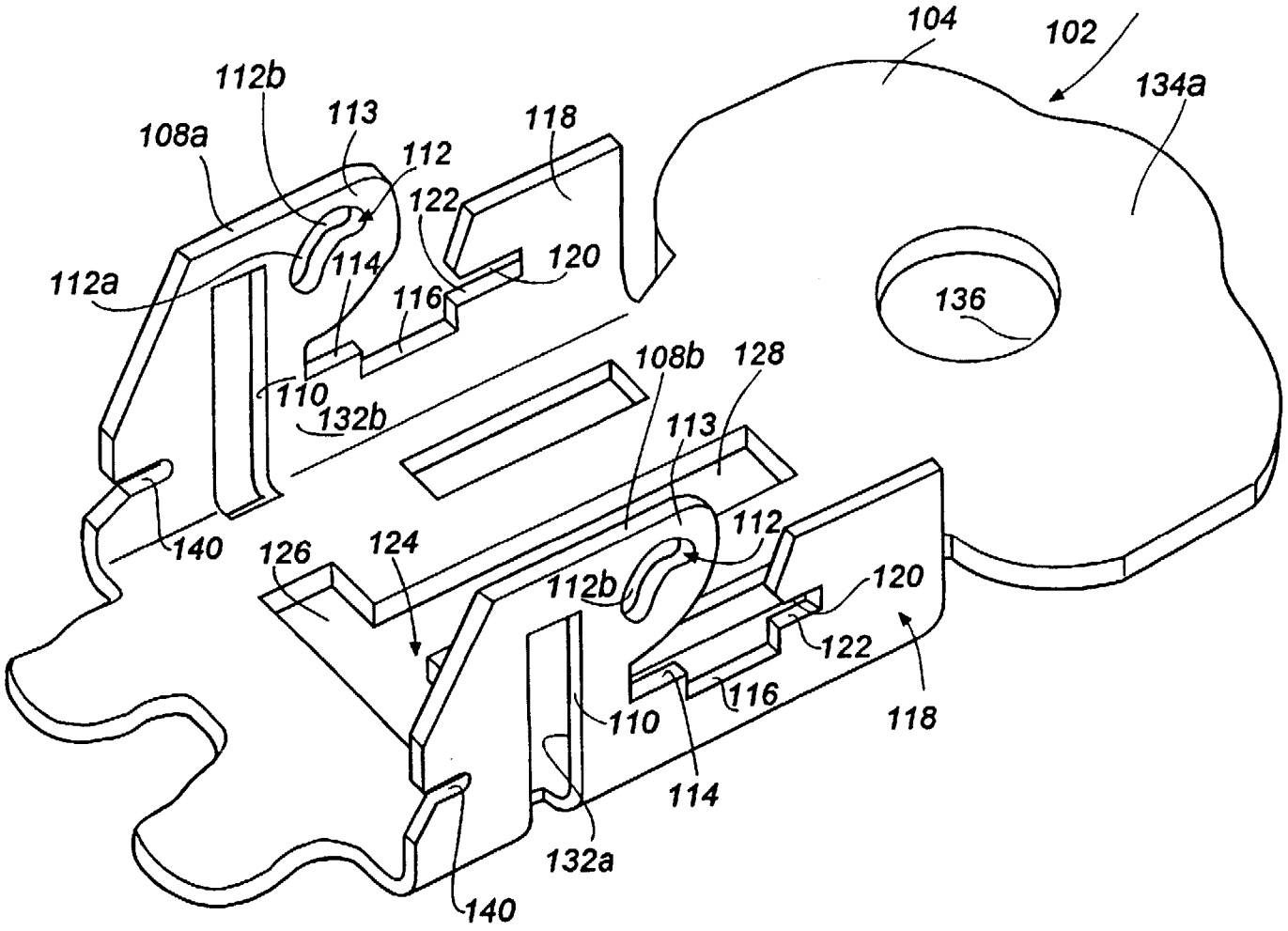
FIG. 2 is an isometric view of the lower buckle frame part 104.

The buckle 100 includes a frame 102 having a lower frame part 104 and an upper frame part 106 which mates with the lower frame part 104. The lower frame part 104 includes two sides 108*a,b*. Each side 108*a,b* includes a vertical slot 110 in an extending portion 113, which serves as a guide for a vertically movable latch plate 180. Each side further includes an arcuate (generally L-shaped) slot 112, having a first portion 112*a* parallel to the slots 108*a,b* and a second portion 112*b* inclined thereto. Each slot 112 is located in the extending side portion or lobe 113, and spaced rearward of the guide slots 110. The sides 108*a,b* additionally include a first ledge 114, which as described below also functions as a mechanical stop for rotating weights (masses) 220*a,b* supported upon the lower frame part 104. Situated behind each ledge 114 is a cutout or groove 116 which receives medial portions 160,162 of the upper frame part 106. Situated behind each slot 116 in a corresponding rear side end 118 is a slot 120 defining another ledge 122. The bottom 112 of the frame part 104 includes a T-shaped slot 124 having a cross-slot 126 which receives a latch portion 182 of the latch plate 180 and an axially extending portion 128 which serves as a guide or housing for an ejector spring 129. One end of the ejector spring is received on an upstanding boss 130 (formed by a bent portion of the upper frame 106), the other end of which is in contact with the ejector 131. The ejector 131 is generally rectangular shaped and is guided fore and aft as it slides against the inner walls 132*a,b* of the sides 108*a,b*. The lower frame part 104 includes an end piece 134*a* having an optional opening 136. The front of each side 108*a,b* includes a slot 140 which receives and aligns the lower frame part 104 to the upper frame part 106.

Figure 3:
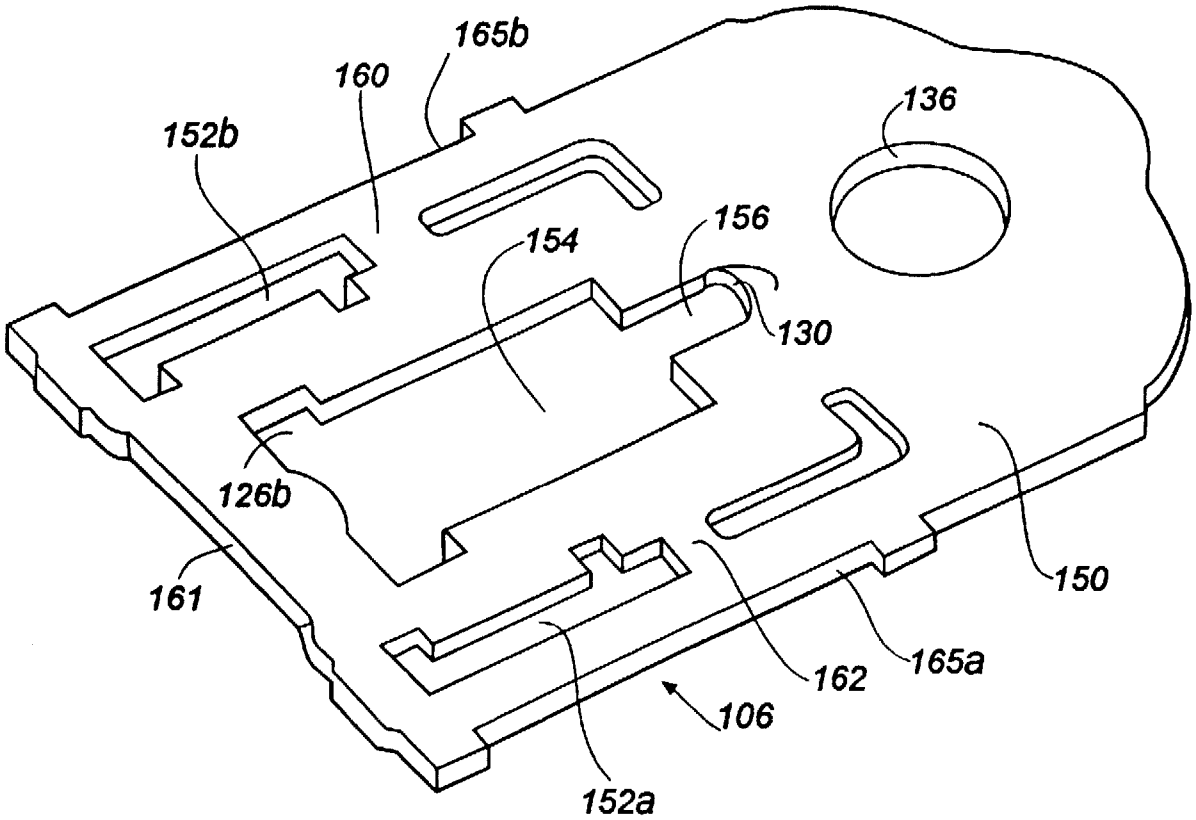
FIG. 3 is an isometric view of the upper buckle frame part 106.
Figure 4:
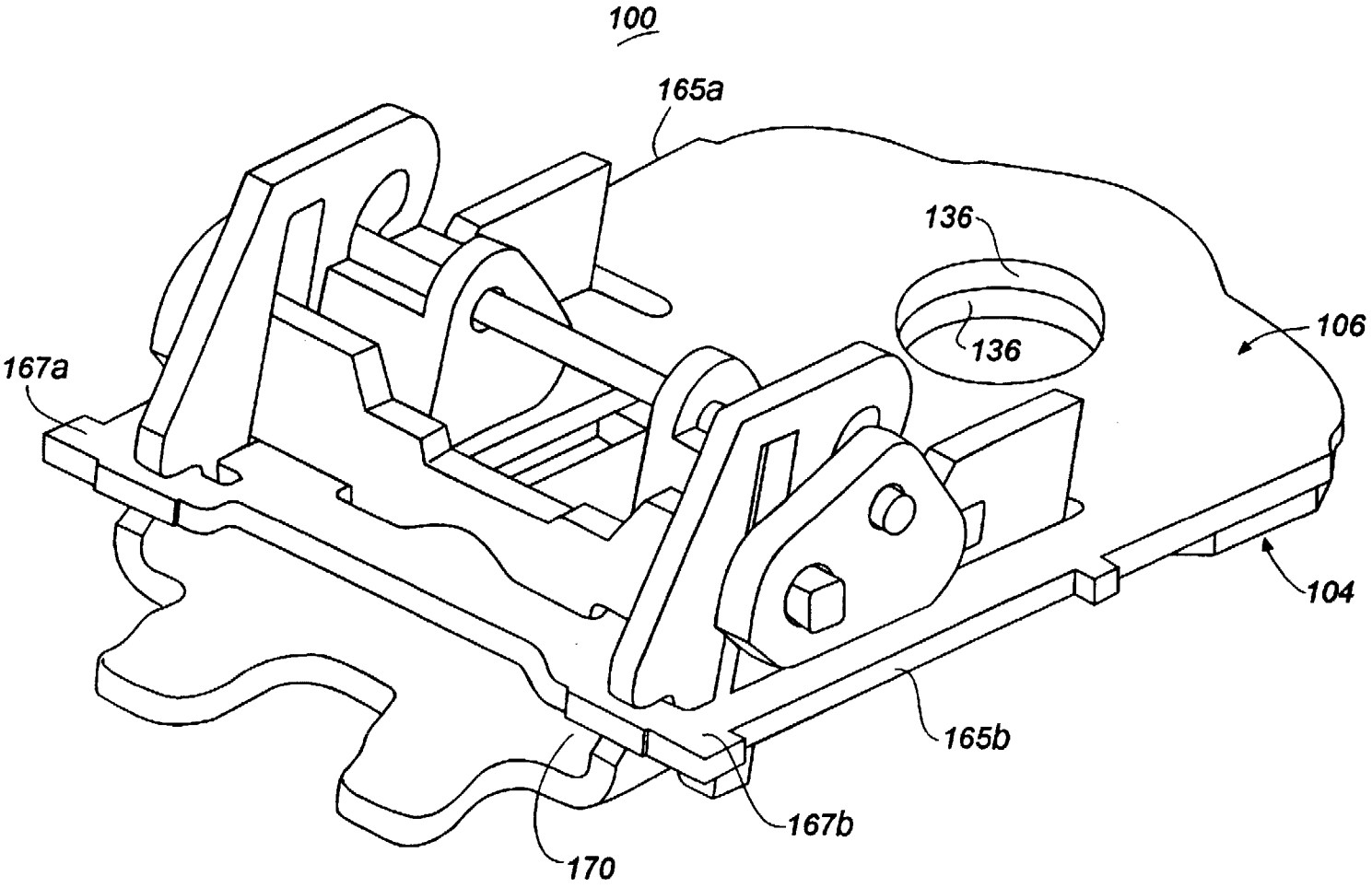
FIG. 4 is an isometric view of the assembled buckle frame.
Figure 9:
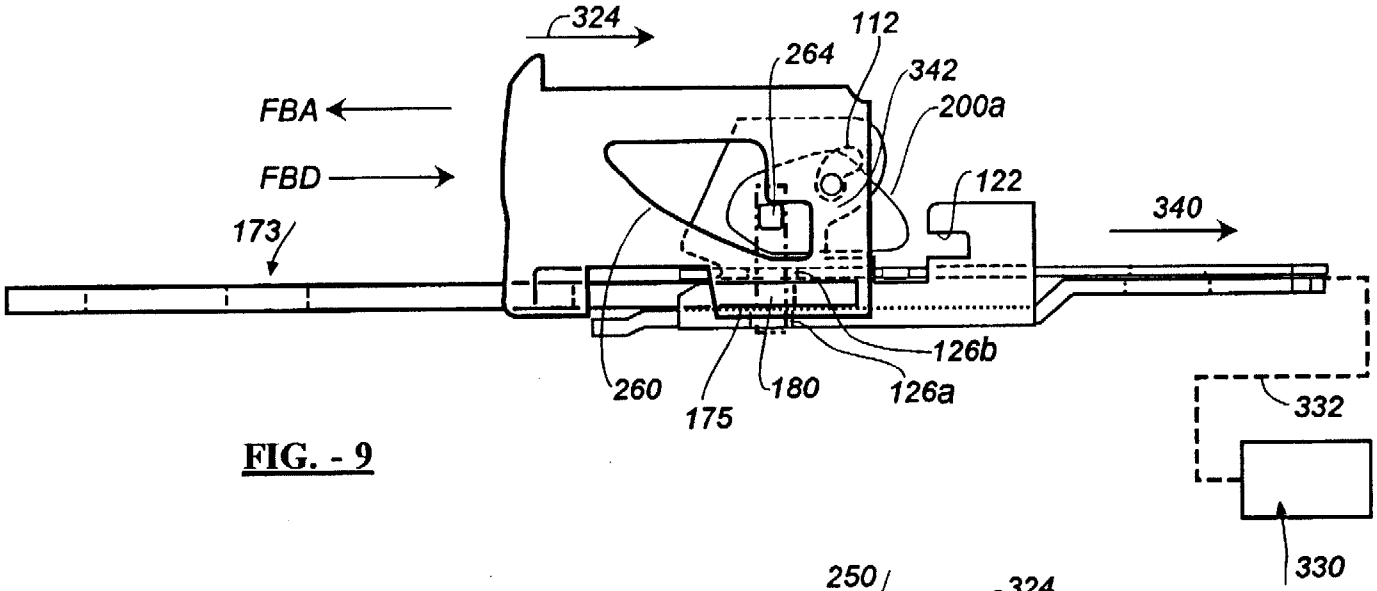
FIG. 9 shows the buckle in its locked or latched configuration.

The upper frame part 106 is formed from a thin flat plate 150 having a set of spaced openings 152*a,b*, a central opening 154 having a narrow extending slot 156 and cross slot 126*b*. Slot 156, when in position upon the lower frame part 104, is collinear to the axially extending portion 128 (in the lower frame part 104) and functions as a guide for a mating portion of the ejector 131. The lower frame part 104 includes an end piece 134*a* having an opening 136 of the same size as opening 136 in the upper frame part 106. When the frame parts 104 and 106 are attached these openings 136 are aligned one to the other. This configuration is shown in FIG. 4 which is an isometric view of the assembled frame parts 104 and 106. A cable 332 is attached to the buckle 100 through the end pieces 134*a,b*, typically through the aligned openings 136 and attached to a belt tensioning device which is also referred to as a pretensioner 330 as shown in FIG. 9. The assembly of the lower and upper frame parts is rather conventional and is known in the art. The slots 152*a,b* of the upper frame part 106 are received within the slots 140 on the front of the sides 108*a,b* and the upper frame part is then rotated downward so that the sides 108*a,b* extend therethrough. The upper frame part 106 is laid flat on the lower frame part 104 with medial portions 160 and 162 resting upon the top of the opposing slot or groove 116 in each side. The lateral sides of the opening 152*a,b* are received about the outer walls of each side 108*a,b*. The front 161 of the upper frame part 106 is bent upwardly (see FIG. 3) so that when in place on the lower frame part 104 cooperates to define a slot 170 through which a tongue 173 is received. The sides 165*a,b* of the upper frame plate 106 extend outward over the corresponding sides of the lower frame part 104. The ejector spring is loosely sandwiched between the upper and lower frame parts.

Figure 5:
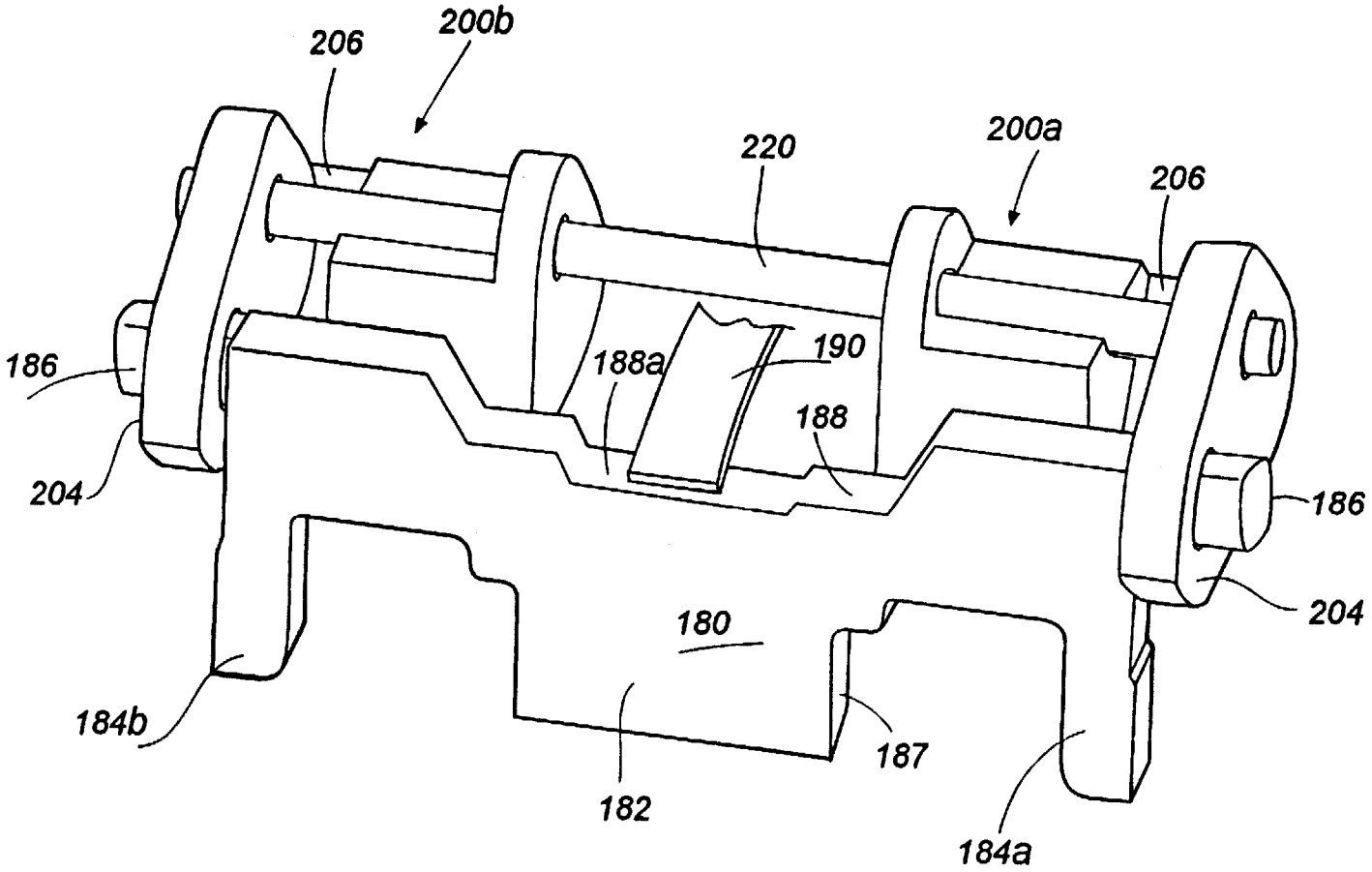
FIG. 5 is an isolated isometric view showing a latch plate, weights and a rod.

Movably situated upon the sides 108*a,b* is the latch plate 180. The latch plate 180 includes a central latch portion 182 received within the slots 126, 126*b* and within a latch receiving opening 175 of the tongue 173, two side legs 184*a,b*, slidably received and guided in the frame slots 110 and two extending, typically square-shaped ends or wings 186. The tip 187 of the central latch portion may be chamfered. The latch plate 180 further includes a stepped top 188 having a center portion 188*a*. A leaf spring 190 acts upon the top center portion 188*a* to bias the latch plate 180 downwardly into the slots 126, 126*a* in the frame parts to its latched position. FIG. 5 is an isolated, isometric view of the latch plate 180 supporting a plurality of weights 200*a,b*, a bar 220 and the leaf spring 190.

Figure 6:
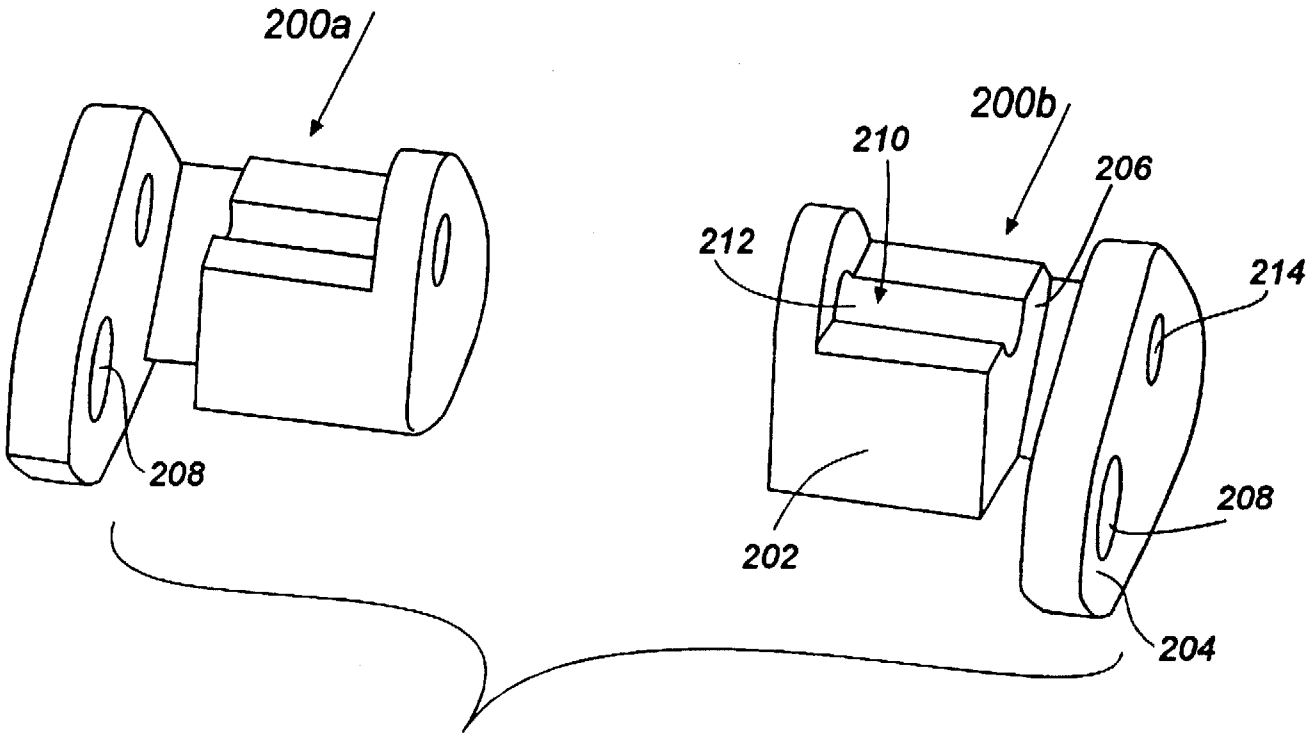
FIG. 6 is an isolated isometric view of two opposingly positioned weights.

The latch plate 180 serves as a support for two inertia weights or masses 200*a,b* each of which are the mirror image of the other. Each weight 200*a* or 200*b* includes a body 202 and a side lobe 204. A portion of the body 202, proximate the side lobe is removed to form a slot 206. As can be seen from FIGS. 5 and 6 the slots 206 permit each mass 200*a,b* to be mounted about the extending parts 113 of the lower frame sides 108*a,b* proximate the arcuate slots 112. Each weight 200*a,b* includes a first circular opening 208 that is loosely received about a respective end or wing 186 of the latch plate 180. Each weight 200*a,b* additionally includes a through bore 210. The bore includes a portion 212 extending through the body and a portion 214 extending through the side lobe 204. In the illustrated embodiment, a portion of the top of the body 202 is removed exposing a part of the bore portion 210, part of which forms a slot A rod 220 is received within the bores 210 in each weight 200*a* and 200*b*. This configuration is shown in FIGS. 4 and 5.

During assembly the latch plate 180 is inserted between the guide slots 110 of the lower frame 104. With the latch plate 180 in an elevated position within the guide slots 110, the weights 200*a*, 200*b* are attached to a respective wing 186, with each respective wing 186 received within an opening 208. The weights 200*a* and 200*b* are rotated about the extending portions 113 of the sides 108*a,b* of the lower frame part 104 with the extending part 113 received with a corresponding groove or slot 206 of a respective weight 200*a,b*. Each weight 200*a,b* is rotated so that its opening 214 is in alignment with a portion of the arcuate slot 112 and the rod 220 is inserted through the weights 200*a,b* and arcuate (or L-shaped) slots 112 to achieve the configuration shown in FIG. 4.

The buckle 100 also includes a button 250. The button 250 is slidably received upon the upper frame parts 106. The button 250 includes an end 252 which is depressed (by its user) to release the tongue 173 from the buckle 100, a top 254 and extending sides 256. Each side 256 of the button 250 includes an opposingly situated slot (or recess) 257 of generally known construction, and slides upon a corresponding extending side 165*a* or 165*b* of the upper and 106. Each button side 256 includes an opening, slot or recess 258 therein, one portion of which is formed as a ramp 260 which engages a lower portion 262 of a corresponding lobe 204 of wing 186 and lifts same. A second portion of the slot (or recess) 258 is formed as a horizontal guide or blocker 264 which when positioned over the wings or ends 186 of the latch plate 180 prevent the latch plate from lifting or being lifted out of the slots 126*a* and 126*b* in the lower and upper frame parts and tongue slot 175.

Situated within the slot 122 of the sides 108*a,b* of the lower frame part 104 is a spring assembly 300. This spring assembly 300 is shown in greater detail in FIG. 1. The spring assembly 300, which is of known construction, includes a body 302 received within slots 122 of each frame side 108*a,b* and within the large opening 154 of the upper frame part 106. One end 304 of the leaf spring 190 is embedded within this body 302. The body also includes a riser 306 having a boss 308. A helical bias spring 310 is received upon this boss 308 and upon another boss 312 within the button 250. This spring 320 serves to bias the button 250 outwardly relative to the frame parts 104 and 106 and resists inward movement of the button 250 as it is depressed by the occupant.

Figure 8:
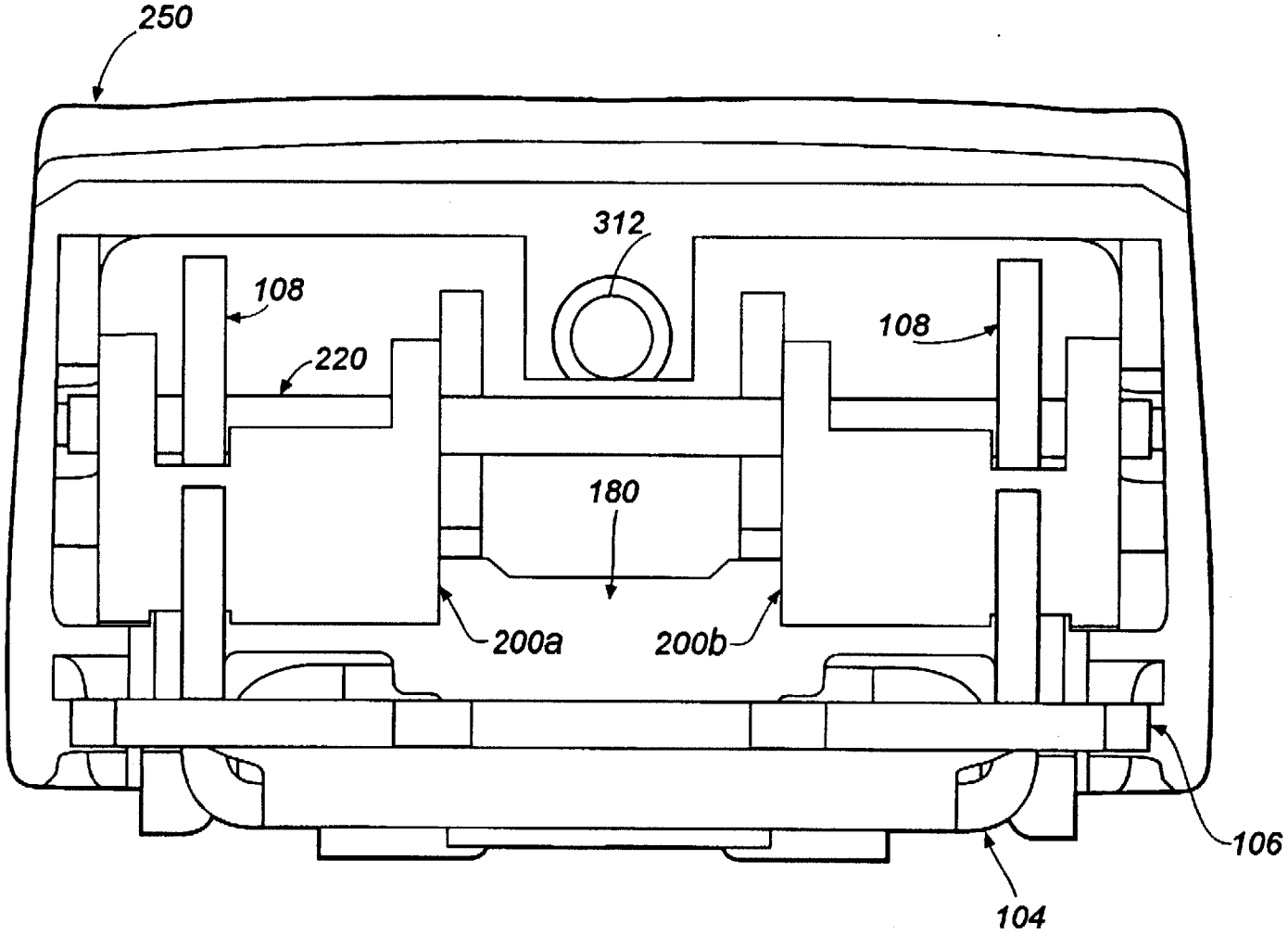
FIG. 8 is a rear view of the buckle showing the interrelationship of the button with many of the major elements of the buckle.

FIG. 8 is a rear view showing the button in place about the frame parts 104 and 106. As can be seen the button sides 256 serve to prevent the bar 220 from displacing laterally.

Figure 7:
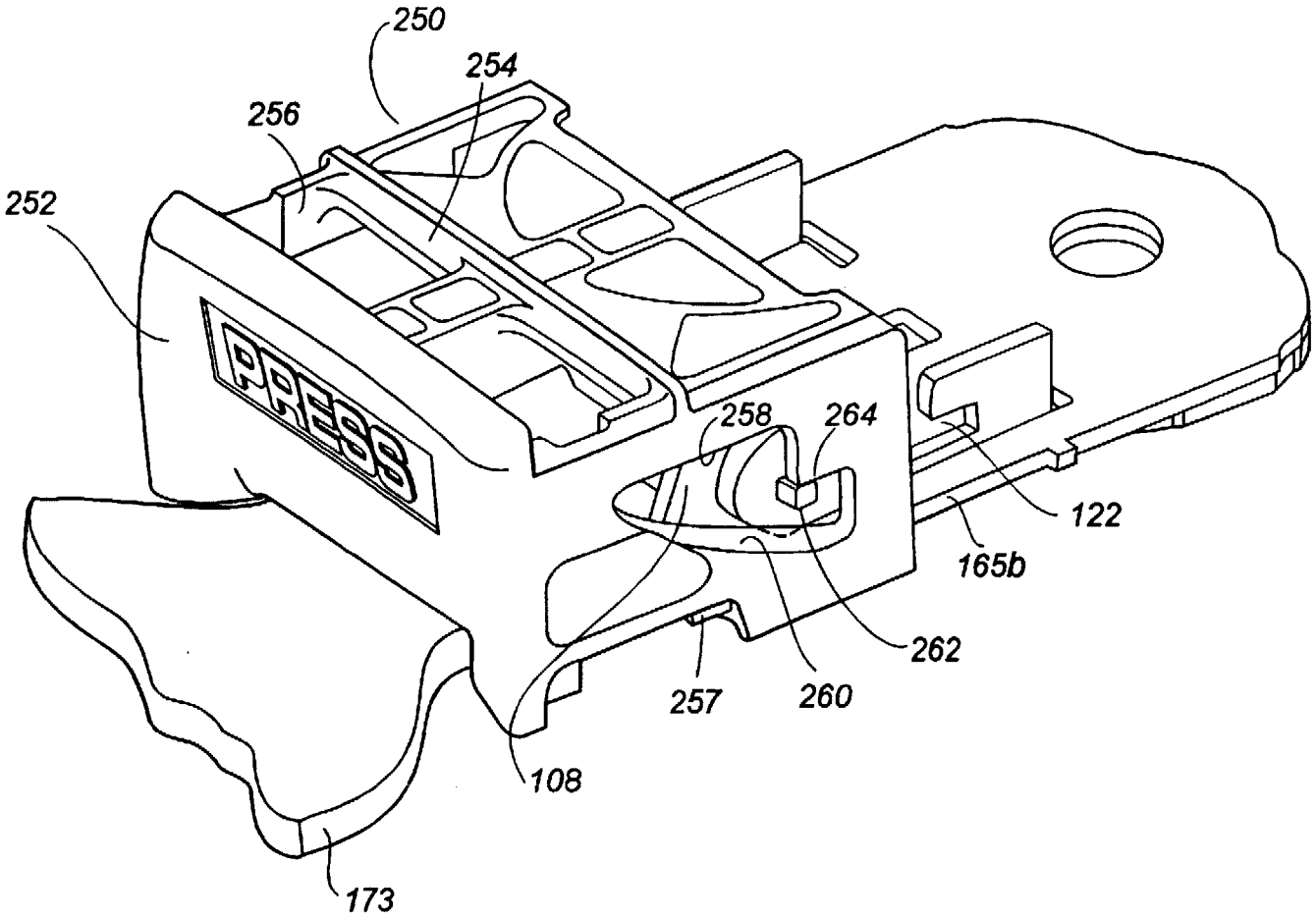
FIG. 7 shows an assembled buckle in its latched configuration with its tongue inserted therein.
Figure 10:
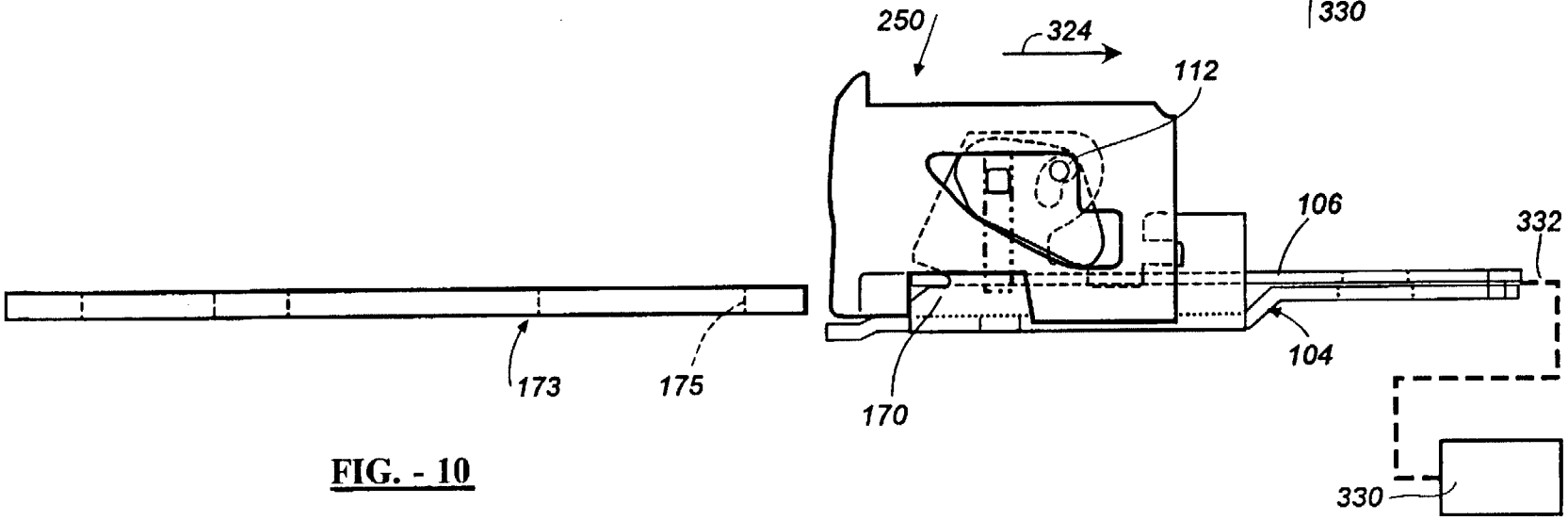
FIG. 10 shows the buckle in its unlatched configuration.

Reference is made to FIG. 9 which diagrammatically shows many of the buckle parts in their positions with the tongue 173 latched in place (also shown in FIG. 7). The spring assembly 300 is not shown in FIG. 9 (and FIG. 10) for clarity. As mentioned above this spring assembly would be fitted in slots 122 and also urges and holds the upper frame part into the slots 116 in the lower frame part. To release the tongue 173 the button 250 is depressed (see direction of arrow 324). As the button is pushed to the right (in FIG. 9), the horizontal guide 264 over-travels the wings 186 of the latch plate 180 and the ramps 260 (on each side of the button 250) after moving a short distance lifts the latch plate 180 upwards out of the slots 126*a,b* in the frame parts and the slot 175 in the tongue 173. Thereafter, the ejector 131 ejects the tongue from the buckle 100. FIG. 10 shows the various parts of the buckle 100 in their release position after being lifted by the button 250 (with the button shown in its fully depressed position). As can be seen the bar 220 has been displaced upwardly and to the right within the slots 120 to permit the weights to rotate slightly as one end of each is lifted.

The following describes the operation of the buckle 100 during pretensioner operation. Upon sensing a crash, the vehicle's electronic control unit (not shown) generates a signal to activate the pretensioner 330. A typical, pyrotechnic pretensioner of known construction includes a tube with a moveable piston therein. The piston is connected to the buckle ends 134*a,b* via a cable 332 (see FIG. 9) accelerating the buckle in the direction of arrow 340. As the buckle is accelerated the frame parts move to the right (in FIG. 9) and the button 250 moves relatively rearward to the left and is stopped by interaction with the flanges 167*a,b* of the upper frame part 106. During this very short time period the weights 200*a* and 200*b* tend to pivot in a clockwise manner about the rod 220 and wings 186 of the latch plate 180 (the center of gravity of the weights is shown by numeral 342). The tendency of the latch plate 180 to be lifted by the rotation of the weights is stopped by the guide or blocker 264 and/or ledge 114. The inertial force acting on the button, during this accelerative phase, is shown as $F_{BA}$.

Within 3–15 milliseconds of the activation of the pretensioner 330 the downward motion (motion to the right as seen in FIG. 9) of the buckle frame is rapidly decelerated as the buckle stops at the end of the travel of the pretensioner 330. The button 250, which initially is in motion (to the right) will tend to stay in motion even after the buckle frame parts are rapidly stopped. The inertial force acting on the button, during this decelerative phase, is shown as $F_{BD}$. In response to these inertial decelerative forces the weights will tend to rotate counterclockwise about the rod 220 and latch plate 180 forcing the latch plate 180 downward further into the various frame and tongue slots 126*a,b* and 173 respectively.

During this decelerative phase the button 250 will also tend to travel to the right and try to lift the latch plate out of the various slots. This motion is resisted by the inertial forces imparted to the latch plate 180 by the weights In operation the weights 200*a,b* are first braced against the frame via the rod 220 and prior to the motion of the button 250 sliding into engagement with the lobes 204. To insure that the button 250 does not lift the latch plate 180 out of the various slots the resultant force (or torque) generated by the weights must be greater than the force imparted by the button 250 to the latch plate.

Many changes and modifications in the above described embodiment of the invention can, of course, be carried out without departing from the scope thereof. Accordingly, that scope is intended to be limited only by the scope of the appended claims.

We claim:

1. A seat belt buckle (100) operable with a pretensioner (330) connected thereto for moving the buckle a determinable distance to remove slack of the seat belt about an occupant, the buckle comprising:

a frame (102), adapted to be connected to the pretensioner (330), defining a tongue receiving opening (170) to receive a tongue (173) as the tongue is moved in a first direction, the frame having a first opening (126*a*) therein, and opposing frame sides (108*a,b*), each side including a latch plate slot (110) arranged generally perpendicular to the first direction and an arcuate slot (112), the arcuate slot (112) including a first portion (112*a*) generally parallel to the latch plate slots (110) and a second portion (113*a*) angled thereto, a latch plate (180), having end portions (186) movable within the latch plate slots between an unlocked position a locked position in engagement with an opening within the tongue and with the first opening (126*a*), weight assembly means, pivotably connected to the latch plate to generate a force upon the latch plate during operation of the pretensioner tending to urge the latch plate into the first opening.

2. The buckle as defined in claim 1 including a button (250) operatively received upon the frame having ramp means (260) for lifting the latch plate to its unlatched position.

3. The buckle as defined in claim 2 wherein the button includes a blocker surface (264) to react with the end portions (186) to prevent the latch plate from lifting out of the tongue when the button is in an unactivated position.

4. The buckle as defined in claim 1 wherein the weight assembly means is connected about ends of the latch plate.

5. The buckle as defined in claim 1 wherein the weight assembly includes a weight pivotally attached to each of the end portions of the latch plate.

* * * * *